United States Patent [19]

Beck et al.

[11] Patent Number: 4,514,931

[45] Date of Patent: May 7, 1985

[54] SECURING DEVICE FOR MANHOLE COVER

[75] Inventors: Alfred Beck; Piet Van Papeveld, both of Edmonton, Canada

[73] Assignee: Allied Flux Reclaiming Ltd., Alberta, Canada

[21] Appl. No.: 626,694

[22] Filed: Jul. 2, 1984

[51] Int. Cl.[3] ..... E05F 15/20

[52] U.S. Cl. ..... 49/21; 220/203; 220/208

[58] Field of Search ..... 220/203, 204, 208; 49/21, 61

[56] References Cited

U.S. PATENT DOCUMENTS

| | | | |
|---|---|---|---|
| 1,717,364 | 6/1929 | Borland | 49/21 |
| 1,955,018 | 4/1934 | Rego | 49/21 |
| 2,009,132 | 7/1935 | Gehris | 49/21 |
| 2,025,839 | 12/1935 | Woods, Jr. | 49/21 |
| 2,247,734 | 7/1941 | Schreiber | 220/203 |
| 2,553,934 | 5/1951 | Olyott | 49/21 |

FOREIGN PATENT DOCUMENTS

| | | | |
|---|---|---|---|
| 303,918 | 9/1930 | Canada | 209/224 |

*Primary Examiner*—George T. Hall

*Attorney, Agent, or Firm*—Hayes, Davis & Soloway

[57] ABSTRACT

The specification describes a pressure release device for use with a manhole cover for releasing excess fluid pressure within a manhole or the like, the device comprising a tubular member having a tubular wall, a fluid inlet at one end thereof, a fluid outlet in the wall, an arrangement at the other end thereof for securing the member to the cover, and an arrangement for securing the member to the manhole adjacent a manhole opening for longitudinal movement of the member between a closed position whereat the cover closes the opening and an open position whereat the cover is removed from the opening permitting fluid flow from the manhole into the member via the inlet and outwardly of the member and the manhole opening via the outlet, the member securing permitting movement of the member from the closed position at a predetermined fluid pressure within the manhole and permitting the member to return to the closed position when the fluid pressure drops below the predetermined pressure.

12 Claims, 5 Drawing Figures

SECURING DEVICE FOR MANHOLE COVER

The present invention relates to a device for securing a manhole cover to a manhole opening and for relieving excess fluid pressure which occurs within the manhole.

BACKGROUND OF THE INVENTION

The present invention is primarily concerned with the problem of and the consequences associated with "popping" of sewer lids by excess fluid or pressure within a drainage system, a situation which is not infrequent in areas which experience extreme weather conditions. One serious consequence is that removal of the cover may be sufficiently forcible as to cause injuries to persons or damage to property in the vicinity of the manhole. Another consequence is that the cover may be carried away with the stream which issues from the manhole opening, thereby requiring retrieval and replacement of the cover. More importantly, this conditions results in an open manhole which, once the excess pressure has been relieved, may present an invitation to children or, as has been known to happen, may actually suck a person into the manhole as water retreats back into the manhole.

Canadian Pat. No. 303 918 granted on Sept. 16, 1930 proposes a solution to the aforementioned problem and, in particular, a manhole cover having a depending skirt having slots extending upwardly from the bottom of the skirt in a tortuous fashion and adapted to receive pins extending inwardly from the manhole opening. Thus, should the water level within the manhole rise up against underside of the cover, the pins and slots cooperate to permit the cover and skirt to rise until the pins reach a horizontal portion of the slots at which point the pins and slots cooperate to hold the cover in an open position. Accordingly, excess water is permitted to escape through openings in the skirt. This arrangement does not entirely illeviate the afore-discussed problems. Firstly, it is conceivable that the pins could be freed from the slots, and the cover thus dislodged, if the water pressure is sufficiently high and applied abruptly, such as by an explosion within the manhole. Secondly, since the device is designed to hold the cover in an open position, it is still necessary to manually close the cover. Thirdly, the complex slot design is relatively difficult and, therefore, expensive to manufacture.

SUMMARY OF THE INVENTION

The present invention seeks to provide a device which secures a manhole cover to a manhole in such a way that the cover is permitted to open under excess pressure conditions and thereby relieve excess pressure and return automatically to its closed position once the pressure returns to its normal level. In addition, the present invention seeks to provide a light weight arrangement which is readily and inexpensively manufactured.

In general, the present invention provides a device for use with a manhole cover for releasing excess fluid pressure within a manhole or the like, the device comprising a tubular member having a tubular wall, fluid inlet means at one end thereof, fluid outlet means in the wall, means at the other end thereof for securing the member to the cover, and means for securing the member to the manhole adjacent a manhole opening for longitudinal movement of the member between a closed position whereat the cover closes the opening and an open position whereat the cover is displaced from the opening permitting fluid flow from the manhole into the member via the inlet means and outwardly of the member and the manhole opening via the outlet means. The member securing means permits movement of the member from the closed position at a predetermined fluid pressure within the manhole and permits the member to return to the closed position when the fluid pressure drops below the predetermined pressure.

BRIEF DESCRIPTION OF THE DRAWINGS

These and other features of the invention will become more apparent from the following description in which reference is made to the appended drawings, wherein.

DESCRIPTION OF A PREFERRED EMBODIMENT

Figure 1:
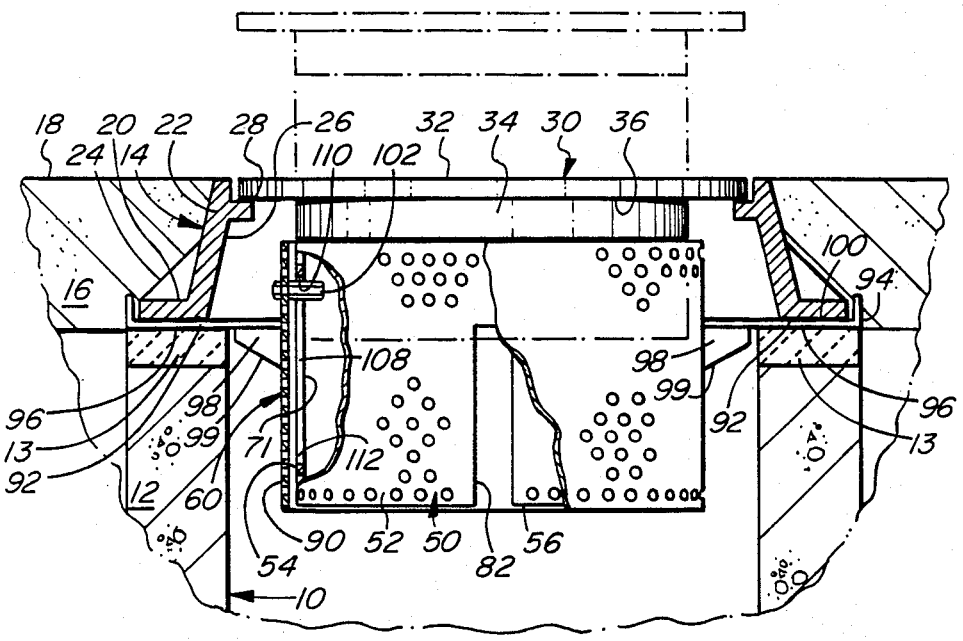
FIG. 1 is a longitudinal cross-sectional view of a manhole opening illustrating a device intended for new manhole construction constructed in accordance with the present invention operatively securing a manhole cover to a manhole in open and closed positions.

FIG. 1 illustrates a typical manhole 10 comprised of a tubular member 12 formed of masonary material, such as concrete, a concrete support ring 13 seated upon the upper end of member 12 and a metal collar 14 seated upon ring 13 and set in asphalt 16 or the like forming a road surface 18. In the illustrated srructure, the collar is unitary and comprised of an annular base portion 20, a conical, tubular neck portion 22 which extends from rhe inner edge of the base, a plurality of radially outwardly extending reinforcing ribs 24 and a radially inwardly extending annular flange 25 at the upper end of the neck portion. Flange 25 is formed with an upwardly facing seat 28 for the cover 30 and, with neck portion 22, defines a manhole opening or hatchway 26.

Figure 3:
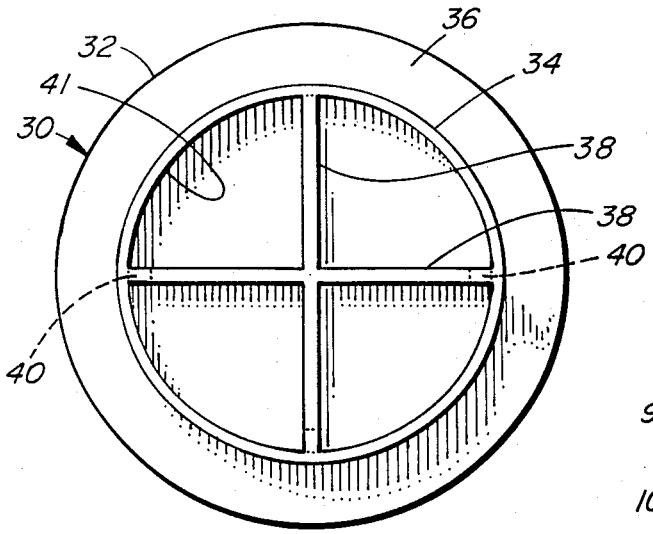
FIG. 3 is a view of the underside of a manhole cover.

Cover 30 is comprised of a disc-shaped portion 32 from which a cylindrical skirt 34 concentrically depends. Disc 32 and skirt 34 together define an annular shoulder 36 which is arranged to sit upon seat 28 of the collar while the skirt is arranged to be telescopingly received within opening 26 as shown. Cross-ribs 38 (see FIG. 3) extend diametrically across the underside of the disc between the inner cylindrical surface 41 of the skirt. Each end of the cross-ribs is formed, adjacent surface 41, with a rectangular aperture 40 whose upper edge 42 is spaced from disc so as to define a key 44, the purpose of which will become clear hereinbelow.

In accordance with the present invention there is provided a device, generally designated by reference numeral 50, for securing the cover to the manhole in such a way as to permit excess water within the manhole to flow outwardly of the hatchway. The device is generally comprised of an inner tubular member or sleeve 52, having a tubular wall 54, which is open at its lower end 56 to define a fluid inlet means. Wall 54 is perforated so as to define a fluid outlet means. Cover securing means 58, in the form of L-shaped fingers, are provided at the upper end of sleeve 52 for detachably securing the sleeve to the cover. Sleeve securing means 60 are provided for securing the sleeve to the manhole adjacent a manhole opening while allowing longitudinal movement of the sleeve between a closed position, shown in solid lines in FIG. 1, whereat the cover closes the opening and an open position, shown in dotted and dashed lines, whereat the cover is removed from the opening permitting fluid flow from the manhole into the sleeve via the inlet means and outwardly of the sleeve and the manhole opening via the outlet means. As explained more fully hereinbelow, securing means 60 permits the sleeve to return to the closed position when the fluid pressure and level within the manhole return to normal.

Figure 2:
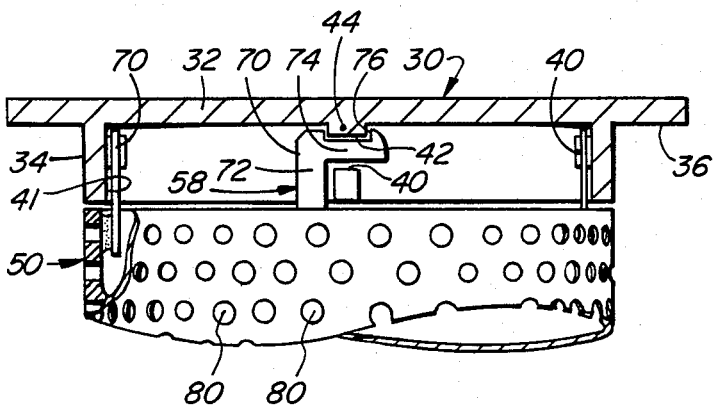
FIG. 2 is a partially broken, partial cross-sectional view illustrating a means for connecting a manhole cover to the device of the present invention.

As best shown in FIG. 2, the outer diameter of sleeve 52 is substantially the same as that of skirt 34 of the cover so that the upper end of the sleeve abuttingly engages the lower edge of the skirt when the two components are secured together in the manner which will now be explained. The cover securing means 58 comprises four equally spaced L-shaped fingers 70. Each finger has one arm 72 which is secured to the inside surface 71 of the sleeve and projects longitudinally beyond the upper end of the sleeve and another arm 74 which extends generally circumferentially of and in spaced relation to the upper end of the sleeve. Arm 74 is arranged to be received within an aperture 40 and is dimensioned so as to be capable of limited axial movement within the aperture while preventing axial separation of the cover and sleeve. The edge of arm 74 remote from sleeve 52 is formed with a notch 76 dimensioned to receive a key 44. Thus, when engaged, the notch and key are operable to prevent rotation of the cover with respect to the sleeve.

To assemble the cover on the sleeve, the fingers are inserted in to the spaces between cross-ribs 38 of the cover and arms 74 are aligned with and inserted into the apertures by rotation of the cover relative to the sleeve until edge 73 of arms 72 abut ribs 38, at which point notches 76 and keys 44 are axially aligned. The cover is then lowered onto the upper edge of the sleeve which places the keys within the notches. The reverse procedure is followed in order to remove the cover. It will be understood that the cover can be readilly removed from inside the manhole simply by lifting the cover slightly, rotating the cover to disengage the fingers from the apertures and then pushing the cover off.

As previously indicated, sleeve 52 is perforated to define a fluid outlet means. More specifically, the sleeve is formed with a multiplicity of small diameter apertures 80 which not only serve as a fluid oulet means but also serve to minimize the weight of the device. The sleeve may additionally be provided with a number, such as four for example, equally spaced, longitudinally extending generally rectangular openings 82 to reduce resistance to fluid flow and to receive the heads of mounting bolts or nuts (see FIG. 5) used in adapting the device to existing manholes.

Figure 4:
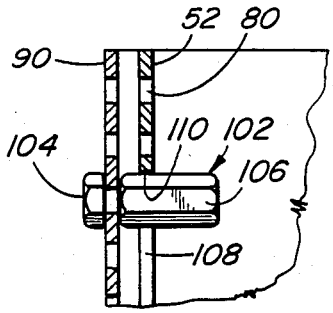
FIG. 4 is a broken cross-sectional view illustrating an arrangement for connecting the device of the present invention to a manhole opening in a new manhole.

A preferred arrangement 60 of securing and guiding sleeve 52 in a new manhole construction will now be described with reference to FIGS. 1 and 4 of the drawings. This arrangement is comprised of an outer tubular member or sleeve 90 which is open at both ends and which is dimensioned to telescopingly receive sleeve 52. Sleeve 90 is provided with a number of arms 92, each formed with an upturned lip 94 at its free end, which are secured to and extend radially outwardly from the mid portion of the sleeve. The underside 96 of arms 92 are adapted to sit upon the concrete support ring 13 of manhole 10 while the upperside 100 of the arms form a seat for base 20 of collar 14. Lips 94 serve to concentrically align collar 14 and sleeve 90. A rib 98 having an upwardly inclined undersurface 99 is provided on the underside of each arm 92 adjacent sleeve 90 for guiding the sleeve into position during initial installation. Sleeve 90 may be perforated if desired to minimize the weight of the assembly.

Retaining means 102 in the form of pins, each of which may comprise a bolt 104 and elongated nut 106, are secured to and extend radially inwardly from the upper end of sleeve 90 as shown. Each retaining means is arranged to be loosely received within an associated elongated, longitudinally extending slot 108 in sleeve 52. Upper and lower ends 110 and 112 of slots 108 are operable when engaged with nuts 106 to define the fully opened and fully closed positions of the inner sleeve. Thus, it will be seen that sleeve 52 is free to move axially between limits defined by the ends of slots 108 while being securely tethered to the manhole.

The sleeves may be formed of any suitable material including steel, plastic, aluminum and the like. It has been found that an arrangement wherein sleeves 52 and 90 are cold rolled from 11 gauge $\frac{1}{8}$ inch perforated steel plate to provide sleeve 52 with an inside diameter of 20 inches and sleeve 90 with an outside diameter of 20 9/16 inches, each with a length of 12 inches and a slot 108 length of 10 inches performs quite adequately for the purposes of the present invention.

Under normal circumstances, the device assumes the position illustrated in solid lines in FIG. 1. Should the water level within the manhole rise to and beyond road level, water pressure will force the cover and sleeve 52 to move upwardly thus allowing water to flow outwardly of the manhole through the apertures in sleeve 52. When the water level returns to normal, the cover and sleeve automatically return to the closed position. It will be seen that this arrangement overcomes the inconvenience and expense of retrieving dislodged manhole covers following a severve storm, but, more importantly, keeps the manhole essentially closed to children, animals and the like.

Figure 5:
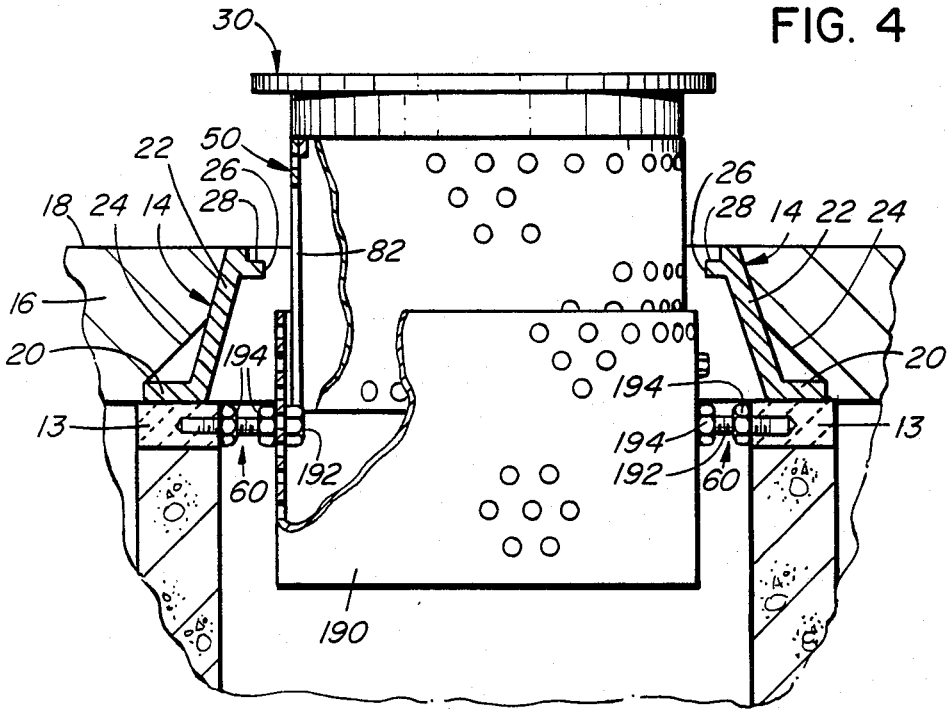
FIG. 5 is a broken cross-sectional view of an arrangement for connecting the device of the present invention in an existing manhole.

Above described sleeve fastening means 60 is a preferred arrangement for use with new manhole installations. FIG. 5 illustrates a sleeve securing arrangement which may be used to readily modify an existing manhole installation. Rather than removing the collar to place arms 92 between the collar and the support ring, as previously explained, there is provided an outer sleeve 190 which is formed without the arms but which is secured to the support ring by means of anchor bolts 192 mounted in the support ring and nuts 194, as shown. The inner ends of the bolts and the inner nuts extending into aforementioned openings 82 in the inner sleeve and, therefore, do not interfere with the operation of the inner sleeve.

It will be understood that an alternative mounting arrangement is to mount retaining means 102 directly in the concrete ring or elsewhere in the manhole. It will be understood that various other modifications and alterations can be made to the above described invention without departing from the spirit of the appended claims.

The embodiments of the invention in which an exclusive property or priviledge is claimed are defined as follows:

1. A pressure release device for use with a manhole cover for releasing excess fluid pressure within a manhole or the like, said device comprising:

a tubular member having a tubular wall, fluid inlet means at one end thereof, fluid outlet means in said wall, means at the other end thereof for securing said member to said cover, and means for securing said member to said manhole adjacent a manhole opening for longitudinal movement of said member between a closed position whereat said cover closes said opening and an open position whereat said cover is removed from said opening permitting fluid flow from said manhole into said member via said inlet means and outwardly of said member and said manhole opening via said outlet means, said securing means permitting movement of said member from said closed position at a predetermined fluid pressure within said manhole and permitting said member to return to said closed position when said fluid pressure drops below said predetermined pressure.

2. A device as defined in claim 1, said outlet means including a plurality of perforations in said wall.

3. A device as defined in claim 1, said outlet means including a plurality of elongated longitudinal slots in said wall.

4. A device as defined in claim 1, said manhole cover securing means being adapted to detachably secure said member to said cover.

5. A device as defined in claim 1, said manhole cover securing means inluding a plurality of locking fingers extending longitudinally from said other end of said member, each said finger having a circumferentially extending portion remote from said member for reception in a mating slot in said cover, whereby engagement between said portions and said slots preventing longitudinal separation of said member and said cover.

6. A device as defined in claim 5, said portion of each said finger having a recess therein for reception of a mating projection in said cover, whereby engagement between said recesses and said mating projections preventing angular displacement between said member and said cover.

7. A device as defined in claim 6, each said slot being dimensioned relative to its associated portion to permit sufficient axial displacement of said member relative to said cover so as to disengage said recesses and said mating projections and thereby permit angular displacement of said member and said cover.

8. A device as defined in claim 1, said means for securing said member to said manhole including a plurality of longitudinally extending slots in said member and a plurality of pin means extending inwardly from said manhole, each said pin means extending through one of said slots and being engageable with the opposed ends of said slots to limit said longitudinal movement of said member.

9. A device as defined in claim 1, said device further including a second tubular member adapted to be rigidly secured to said manhole adjacent said opening and to telescopingly recieve said first mentioned tubular member, said second member having a plurality of radially inwardly extending pin means, said first mentioned member having a plurality of longitudinally extending slots, each said slot being adapted to recieve one of said pin means and being cooperable with its associated pin means to limit longitudinal displacement of said first mentioned member relative to said manhole.

10. A device as defined in claim 9, said second member having a plurality of outwardly extending arms adapted to seat against an annular seat in said manhole and support an manhole collar member.

11. A device for securing a manhole cover to a manhole or the like adjacent a manhole opening and relieving excess fluid pressure within said manhole, said device comprising:

an outer tubular member having a plurality of outwardly extending arm means adapted to seat on an annular seat in said manhole so as to support said member concentrically within said manhole and support a manhole collar, said member further having a plurality of radially inwardly extending pin means;

an inner tubular adapted to be telescopingly received within said outer tubular member, said inner tubular member having a tubu1ar wall, fluid inlet means at one end thereof, fluid outlet means in said wall, means for detachably securing said inner member to said manhole cover, and a plurality of logitudinal slots in said wall, each said slot being adapted to receive on of said pin means and being cooperable therewith to limit longitudinal displacement of said inner member between a closed position whereat said cover is seated on a seat in said opening and an open position whereat said cover is removed from said seat, whereby said inner member is moveable away from said closed position when the pressure within said manhole exceeds a predetermined pressure, engagement between said pin means and their associated slots preventing separation of said inner member from said outer member, and being moveable to said closed position under the influence of gravity when the pressure within said manhole drops below said predetermined pressure.

12. A device as defined in claim 11, said manhole cover securing means inluding a plurality of locking fingers extending longitudinally from said other end of said inner member, each said finger having a circumferentially extending portion remote from said member for reception in a mating slot i-n said cover, whereby engagement between said portions and said slots limiting longitudinal separation of said inner member and said cover, said portion of each said finger having a recess therein for reception of a mating projection in said cover, whereby engagement between said recesses and said mating projections preventing angular displacement between said member and said cover, each said slot being dimensioned relative to its associated portion to permit sufficient axial displacement of said member relative to -said cover so as to disengage said recesses and said mating projections and thereby permit angular displacement of said member and said cover.

* * * * *